US005702052A

United States Patent [19]

Bonner

[11] Patent Number: 5,702,052

[45] Date of Patent: Dec. 30, 1997

[54] BIN OF LAMINATED MATERIAL

[75] Inventor: Craig Ronald Bonner, Auckland, New Zealand

[73] Assignee: Carter Holt Harvey Limited, Manukau City, New Zealand

[21] Appl. No.: 539,903

[22] Filed: Oct. 6, 1995

[30] Foreign Application Priority Data

Oct. 6, 1994 [NZ] New Zealand ..... 264630

[51] Int. Cl.[6] ..... B65D 3/22

[52] U.S. Cl. ..... 229/4.5; 53/471; 220/443; 229/198.2; 229/939; 428/182; 493/463

[58] Field of Search ..... 229/4.5, 5.5, 5.6, 229/5.7, 5.8, 198.2, 939; 428/182; 53/467, 471; 220/443; 493/463; 156/462

[56] References Cited

U.S. PATENT DOCUMENTS

| | | | |
|---|---|---|---|
| 1,808,975 | 6/1931 | Wright | 229/4.5 |
| 2,053,680 | 9/1936 | Page | 229/4.5 |
| 2,053,685 | 9/1936 | Leopold et al. . | |
| 2,271,455 | 1/1942 | Finn | 229/4.5 |
| 2,630,934 | 3/1953 | Elmendorf . | |
| 2,755,983 | 7/1956 | Ringler | 229/4.5 |
| 3,145,131 | 8/1964 | Finke | 229/939 |
| 3,383,025 | 5/1968 | Ferrey et al. . | |
| 3,410,473 | 11/1968 | Petrie | 229/4.5 |
| 3,433,400 | 3/1969 | Hawkins . | |
| 3,712,530 | 1/1973 | Croley . | |
| 3,937,392 | 2/1976 | Swisher . | |
| 4,347,934 | 9/1982 | Goodman | 229/4.5 |
| 4,881,683 | 11/1989 | Linnemann . | |

FOREIGN PATENT DOCUMENTS

| | | |
|---|---|---|
| 86604/75 | 5/1977 | Australia . |
| WO 86/05464 | 8/1986 | WIPO . |
| WO 87/03558 | 6/1987 | WIPO . |
| WO94/19538 | 9/1994 | WIPO . |

OTHER PUBLICATIONS

The Wiley Encyclopedia of Packaging Technology, John Wiley & sons, (1986) pp. 66–68.

*Primary Examiner*—Gary E. Elkins
*Attorney, Agent, or Firm*—Jacobson, Price, Holman & Stern, PLLC

[57] ABSTRACT

A bin formed with a general circular shape in plan being formed from an outside liner of paperboard and an inner paperboard flute providing medium which is affixed to the outside liner. The flutes of the flute providing medium are larger than those of "A" flute. A removable sleeve interior, an optional base and lid are provided together with methods of carriage using same.

38 Claims, 9 Drawing Sheets

BIN OF LAMINATED MATERIAL

TECHNICAL FIELD

The present invention relates to improvements in and or relating to bins.

BACKGROUND ART

In our PCT Application No. PCT/NZ94/00006 there is disclosed a laminated product of a flute providing medium and a liner for each side of the flute providing medium, where the flute providing medium is a corrugated board having a flute pitch and depth greater than that of "A" flute, the corrugated board having the flutes thereof extending substantially vertically and being unbroken at least between the comers of the walls of the case or being lapped to provide no breaks between at least the comers of said case.

In the same specification in another form the flute providing medium between a pair of liners is instead defined as having a flute pitch of about 54 mm, a flute depth of about 27 mm and a take up of about 1.54:1.

ASTM D996 (American Society for Testing and Materials) defines 'A' flute as having 36=3 flutes per linear foot, 7.9 mm to 9.1 mm span between adjacent flutes and an approximate height (not including thickness of facing) of 4.7 mm. Commonly A flute is defined in the packaging industry as having 110 flutes/metre, an average medium take-up factor of 1.54 and a flute height of 4.7 mm.

DISCLOSURE OF INVENTION

The present invention is directed to a bin capable of having its own bottom or capable of being rested on a and/or slip sheet and/or pallet which is formed from materials such as those disclosed in PCT/NZ94/00006 but which has the advantage of providing a maximum of volume for a minimum of material (irrespective of whether or not it is used with an optional liner sleeve) and at the same time, when used without an optional unattached liner, reduces the volume that might otherwise be taken up with a laminate of the kind disclosed in PCT Application No. PCT/NZ94/00006 and converts that saving into volume in addition to that saved by the particular chosen plan of the wall structure.

The present invention relates to a bin (bottomed or bottomless) of substantially circular or elliptical wall plan, where the wall is a laminate of an outside liner and inside of the liner a flute providing medium of vertically running flutes wherein a) said flute providing medium is a board having a flute pitch and depth greater than that of "A" flute, and/or b) said flute providing medium is fibre board heat formed to provide a flute pitch and depth greater than that of "A" flute, and/or c) said flute providing medium is formed of kraft liners sandwiching another or a similar choice of cellulosic fibres and which has been corrugated in the presence of moisture, heat and pressure to provide structural integrity as well as forming the times thereof, and/or said flute providing medium is a board having a flute pitch of about 54 mm, a flute depth of about 27 mm and a take up of about 1.54:1.

Preferably said flute providing medium is a fibre-board or a laminated fibre-board.

Preferably said bin is of substantially circular wall plan.

Preferably said flute providing medium is lapped at least one point by at least one flute width.

Preferably said time providing medium is lapped at two points preferably diametrically opposed.

Preferably said outer liner is encircled by at least one strengthening band (and preferably a series thereof).

Preferably said bin has adhered to the base thereof or has underlying the base thereof a sheet preferably of a card or laminated material capable of being positioned on a pallet or other support surface.

Preferably said bin can conform to a substantially lie-flat form with the flutes intermeshed, said bin being definable by opening from such lie-flat form, and, optionally associating a bottom defining member therewith.

Preferably said lie-flat form relies on hinging of said outside liner along two vertical pairs of fold lines, each fold line to provide an edge in said lie-flat form.

Preferably said outside liner is fabricated from two parts, one of which carried both of said pairs of fold lines.

Preferably said outside liner has at the base thereof flaps engageable from below a bottom defining disc of a sheet material.

Preferably the bin as hereinafter described.

Preferably said bin has a volume greater than 500 liters and a height greater than 600 mm yet with a capability of supporting at least 6 tonnes in a stacking mode.

In a further aspect the present invention consists in a bin as previously defined in combination with a capping member.

Preferably said capping member includes a lidding region and a skirt or flange like region to cap over the upper regions of the outer liner of the laminate.

Preferably said combination includes a plastics bag fillable to conform to the insides of said bin.

In yet a further aspect the present invention consists in the use of a bin or a combination in accordance with the present invention to transport goods, said bin in use and loaded having been positioned on an appropriate support surface.

BRIEF DESCRIPTION OF DRAWINGS

Preferred forms of the present invention will now be described with reference to the accompanying drawings in which.

Preferred forms of the present invention will now be described with reference to the accompanying drawings in which.

In a preferred form of the present invention the bin is formed from an outer liner 1 (eg; a solid fibre material) while the flute providing medium 2 is preferably a single or double thickness of a sheet (eg; of solid fibre board). In this respect the full content of PCT Application published as W094/19538 is hereby incorporated by way of reference.

The body of the bin can be seen avoids the need for an inner liner to correspond to that of the outer liner 1. Instead where necessary the thickness of the flute providing material can be increased.

The effect is to increase the internal volume of this structure since the flutes that open to the interior of the bin are not occluded from invasion by a particulate or liquid material, for example, a plastics liner bag 3 can conform to the interior shape of the structure.

Encircling bands for, are preferably provided, around the outer liner to confer enhanced strength to the overall product. Suitable bands include those of a plastics material capable of being source from Danband Products (Australasia) Limited.

Figure 5:
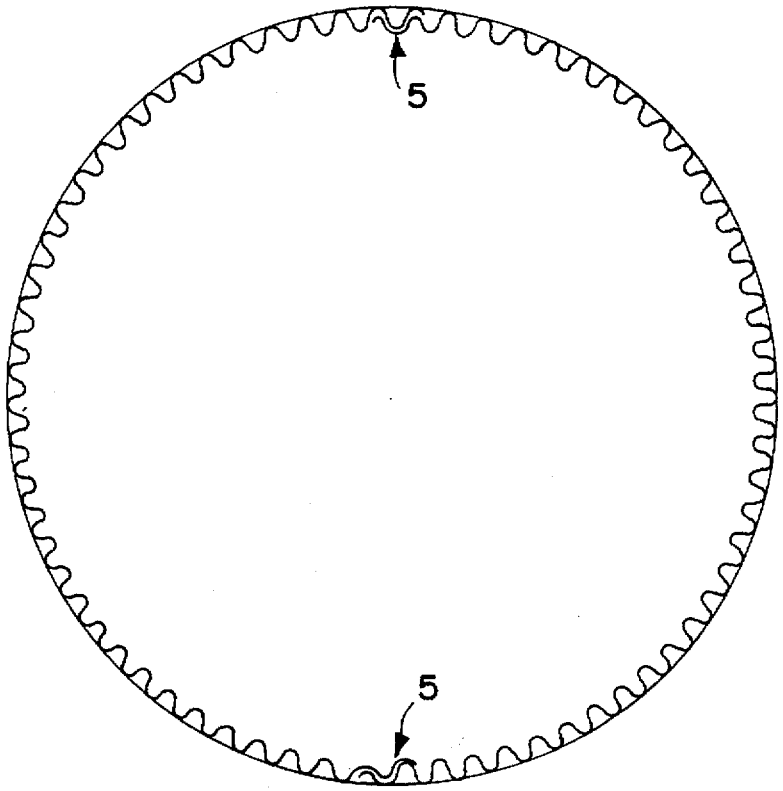
FIG. 5 is a plan view of an arrangement shown in FIG. 3 but this time showing the flute providing medium as having been defined by two or three sheets each extremity of which laps preferably by at least one flute width with the associated sheet.
Figure 6:
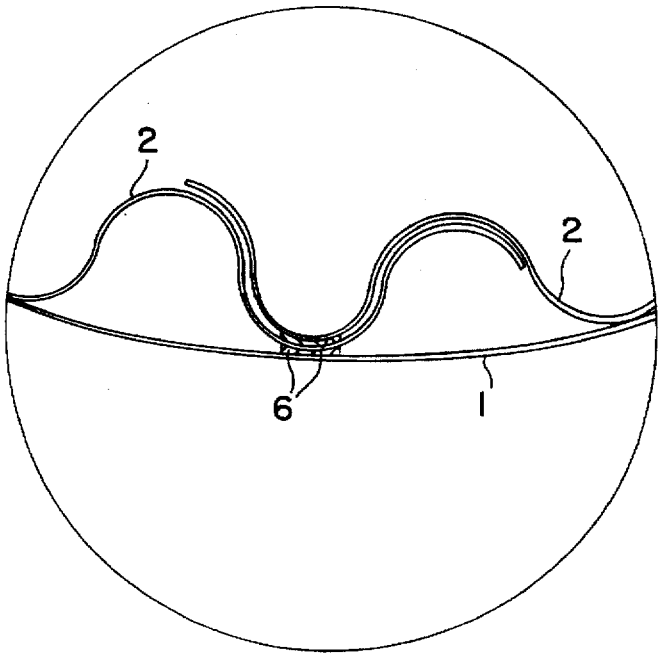
FIG. 6 is a close up of the overlapping showing in cross section the adhesion which as a very minimum is provided at the region of overlap.
Figure 7:
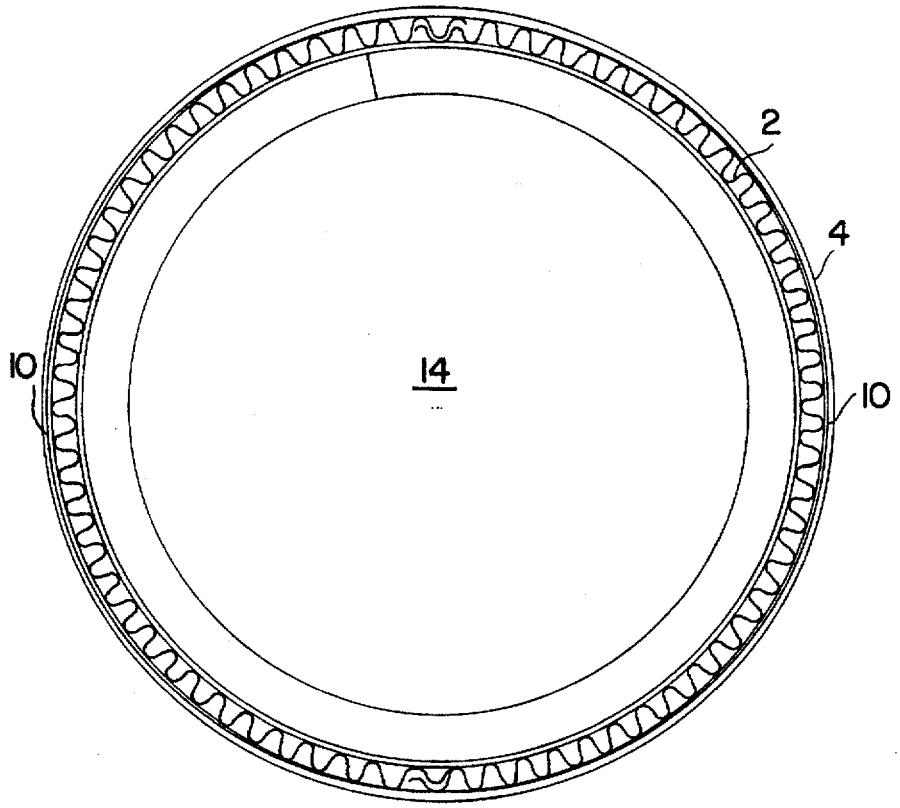
FIG. 7 is a plan view of a preferred form of the present invention showing a lie flat type bin assembly but when assembled (but without lid)
Figure 8:
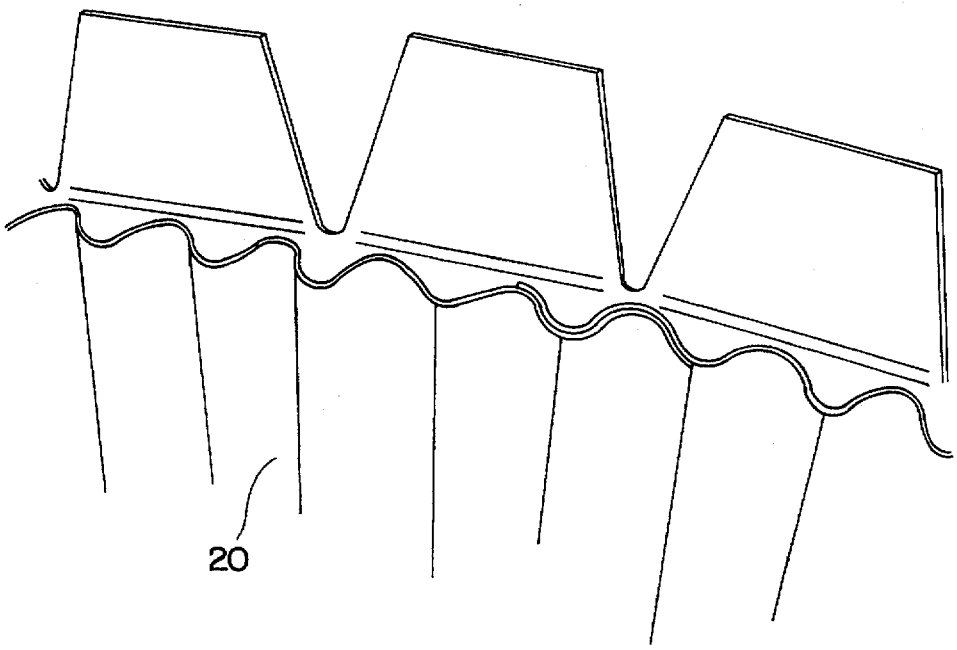
FIG. 8 shows an inner perspective view from the base of a bin as shown in FIG. 7.

FIG. 5 shows how if desired the flute providing medium can be formed from more than a single sheet by appropriate lapping at regions 5, the detail of which is shown in an enlarged form in FIGS. 6 with adhesive 6 holding the two sheets at their lap position in association and to the outer liner 1, not shown as the adhesive that affixes each alternate flute of the flute providing medium on its convex side to the inside surface of the flute providing medium. An appropriate adhesive is an appropriate PVA or EVA.

From the foregoing it can be seen that the strength characteristics possible with a flute providing medium as previously defined and is defined in the aforementioned PCT Application (but then only when in a sandwiched form) can provide a structure suitable when supported on a pallet or a slip sheet etc of carrying bulk materials. By assembling the bin with the flutes exposed internally we have in effect halved our wall thickness volume and the internal bag tends to form into the contours of the flutes.

Figure 1:
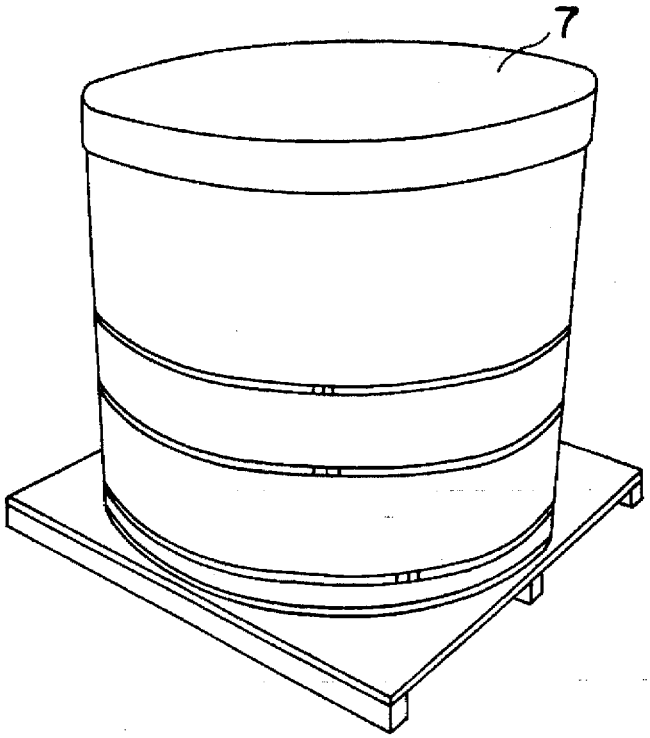
FIG. 1 is the perspective view of a capped bin in accordance with the present invention mounted on a pallet preferably on top of an appropriate slip sheet or the bin itself having adhered to the base thereof a bottom sheet of, for example, a similar material to that of the outer liner.
Figure 2:
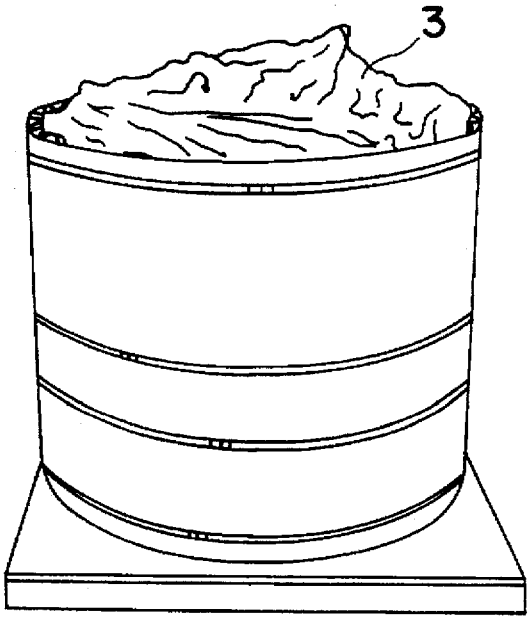
FIG. 2 is a similar view to that of FIG. 1 but showing the cap removed and showing how if desired particular materials or liquids to be confined within the bin on the support surface supported by or defined by the pallet can be bagged in, for example, a plastics material so as to conform to the interior of the bin walls.
Figure 3:
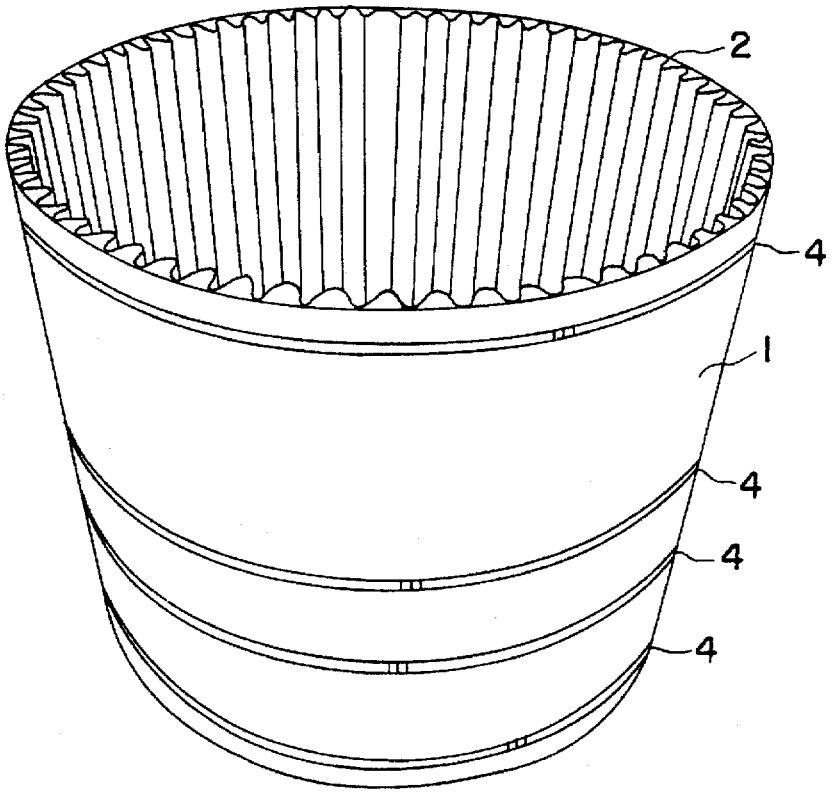
FIG. 3 is a perspective view of a bin as shown in FIG. 2 showing greater detail the wall make up, ie; an outer liner preferably of a solid fibre board and an inner lining of the flute providing medium.
Figure 4:
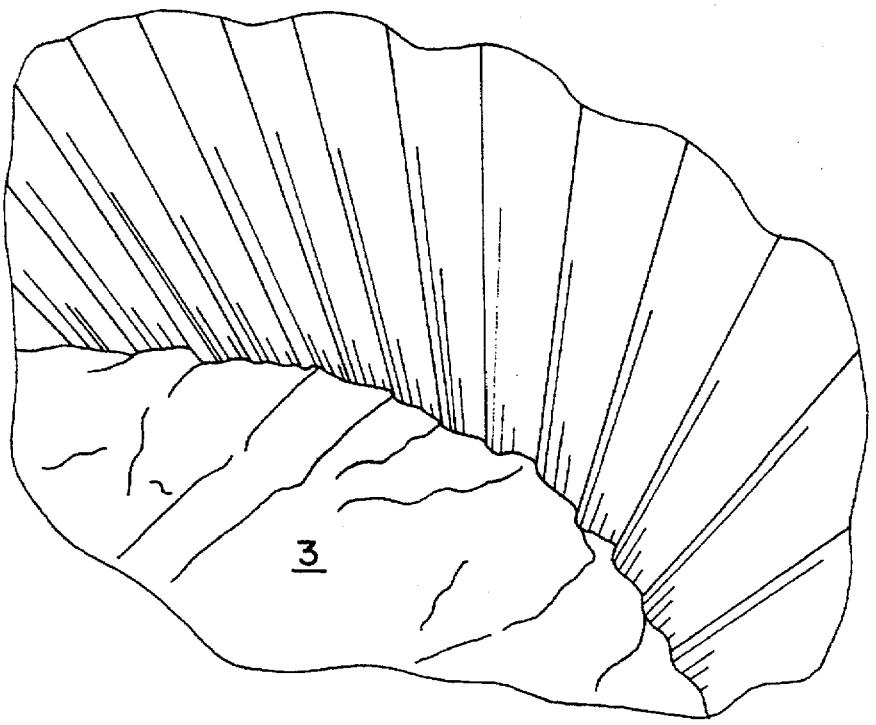
FIG. 4 is a view towards the base of the arrangement shown in FIGS. 3 showing how in an empty mode a carrying bag of a plastics material can be positioned at the base 30 for filling.

The bin can optionally include a body ramp with caps top and/or bottom or simply a pad glued to the bottom. The cap 7 is shown in FIG. 1.

Size of the bin will vary accordingly to purpose but a typical size is 1140 mm outside diameter. Height would vary according to volume required and the transportation method, eg; containerisation is restrictive on height.

A most preferred form of the present invention will now be described with reference to FIGS.7 through 26.

The preferred form of bin in accordance with the present invention can be of any dimension but preferably with an outside diameter of the order of 1140 mm and a height substantially the same.

Such a bin if provided with a removable inner sleeve (in order to reduce pressure on the flute providing medium) provides a volume of the order of 936 liters. Bins in accordance with the present invention of course can have a variety of outside diameters and a variety of heights and thus volumes. When the bin is of the dimensions states however static compression test in stacking of the order of 10 to 12 tonnes is achieved ie; the loading that can be provided on the top of such a bin in a stack situation.

Figure 14:
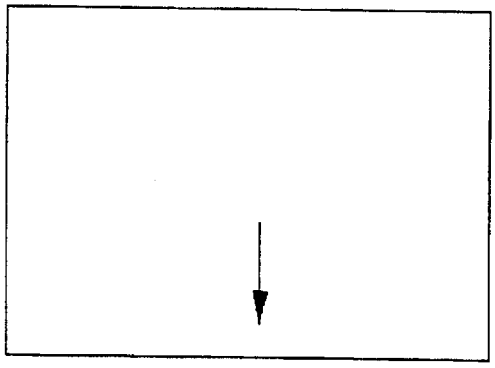
Figure 15:
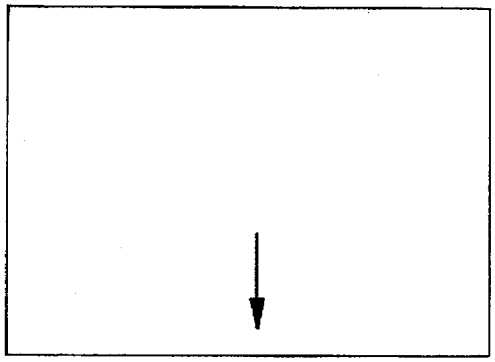
Figure 16:
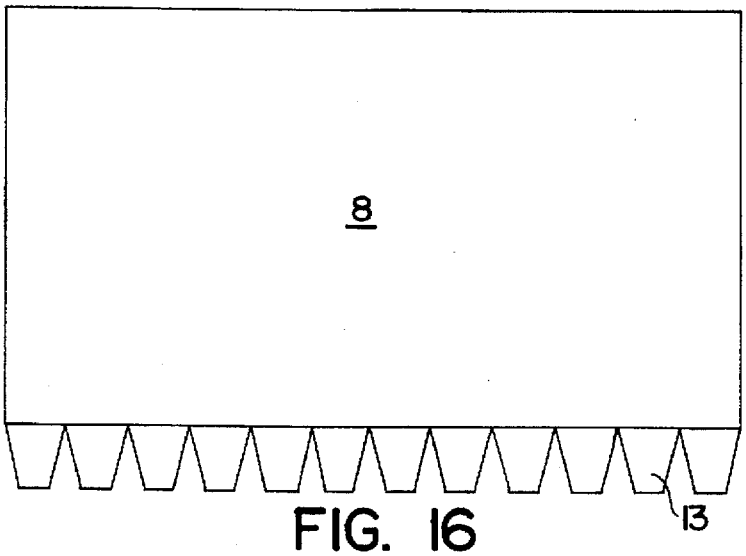
Figure 17:
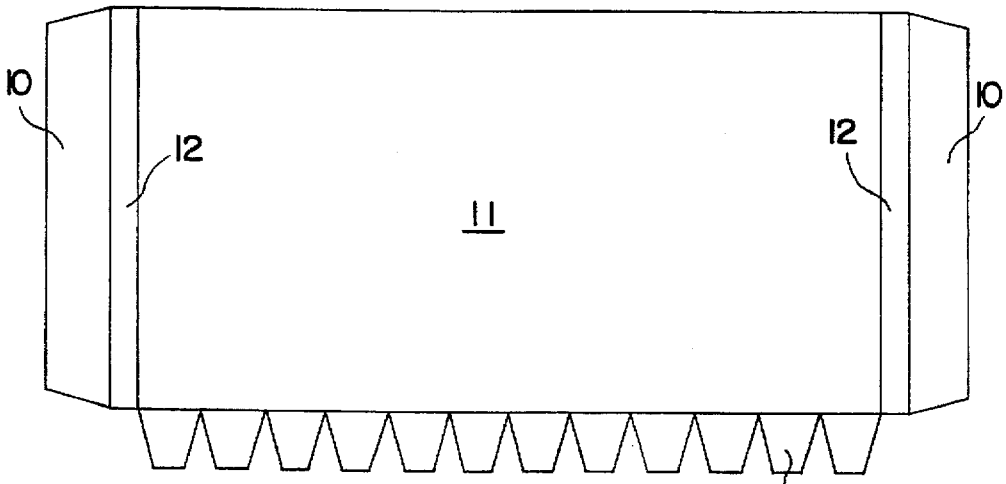
Figure 18:
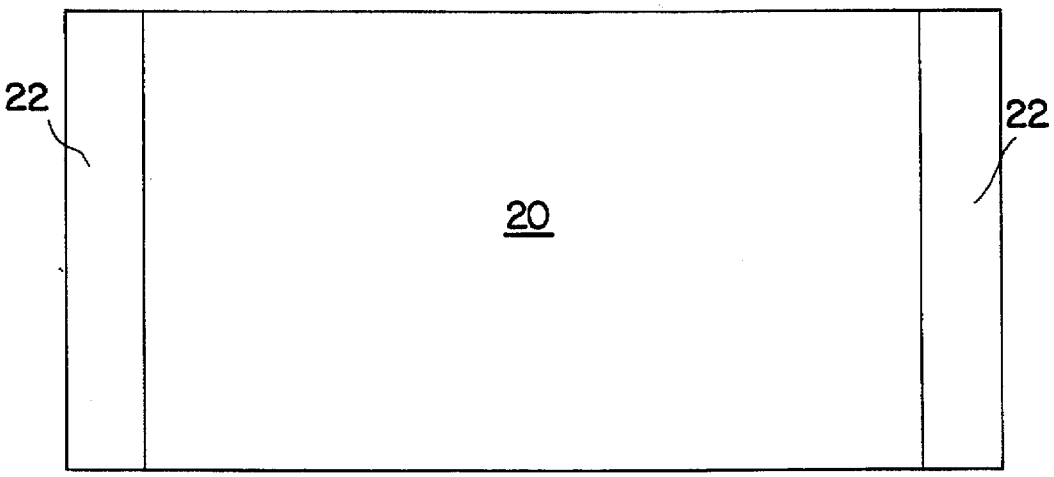
Figure 19:
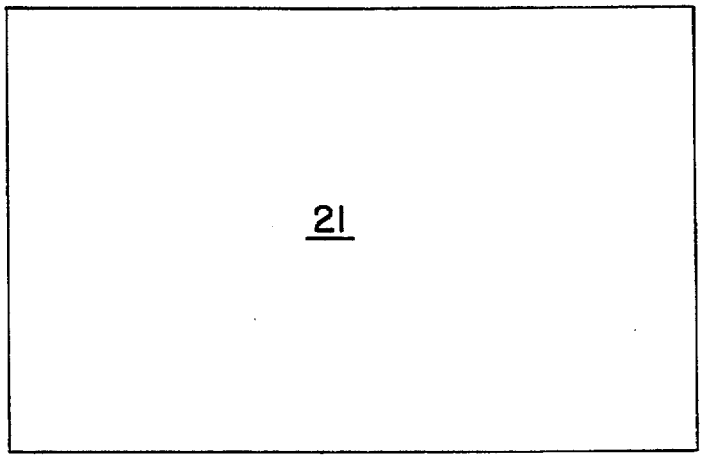
Figure 21:
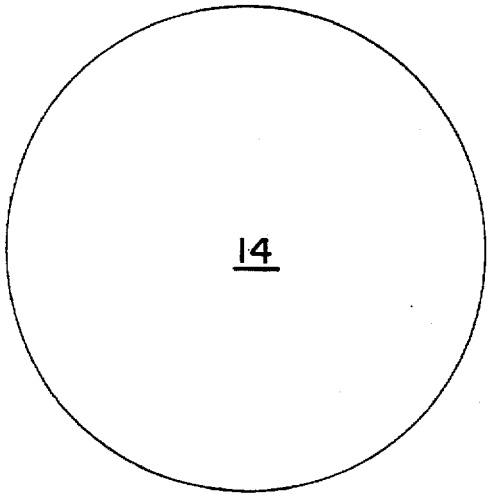
Figure 22:
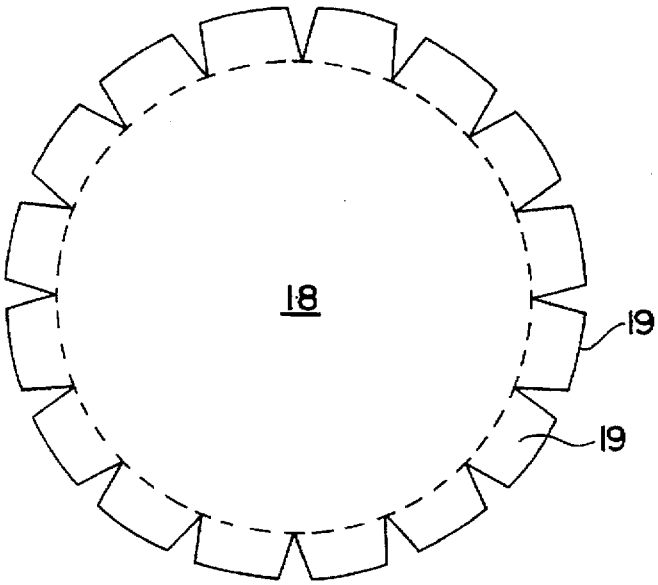

In the preferred form of the present invention the components are made up as follows a) a component as shown in FIG. 16 which forms part of the outer liner, the projections at the lower end to be folded under and preferably to be adhered to an internal base, b) a component as depicted in FIG. 17 preferably with two parallel scores at each end so as to assist lie flat arranging thereof when the outer end flaps overlies and is adhered to the structure of FIG. 16, FIG. 17 again forming part of the outer liner, c) a component as shown in FIG. 14 which forms part of the flute providing material, there being four members for each bin of the configuration of FIG. 14, d) a component as depicted in FIG. 15 which again forms part of the flute providing material, there being four components of the configuration of FIG. 15, FIGS. 14 and 15 showing with the arrow the grain direction of the material and being configured so as to be conformable during a lamination procedure to provide the flute providing material to be described hereinafter in more detail, e) a base disc as shown in FIG. 21 to fit internally of the outer liner and to be supported internally thereof by the base flaps shown in the components of FIGS. 16 and 17, f) a component as shown in FIG. 18 with its end flaps which forms part of a removable inner sleeve, g) a component as shown in FIG. 19 which forms part of a removable inner sleeve to be attached by adhesion to the member as shown in FIG. 18 to form the sleeve, such an inner liner when assembled being of a lie flat construction but openable to sit stably on the base disc 21 within the flute providing medium so as to rest against the inward extremities of the flute providing material, h) one of four components to be used in pairs to provide a top and bottom outer bands for the outer liner to be adhesively affixed thereto as hereinafter described.

Figure 12:
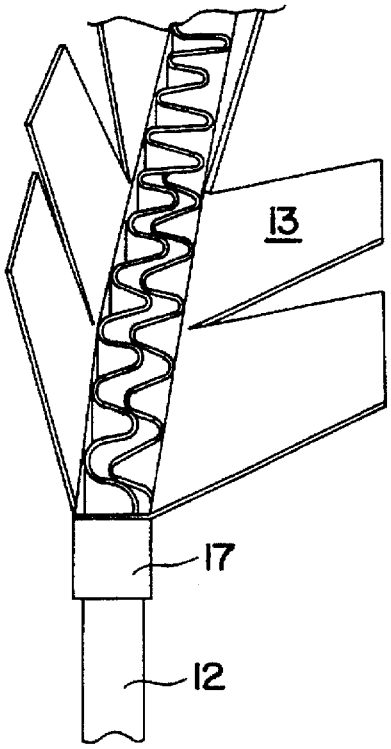
FIG. 12 shows the intermeshing of the flute providing medium in the lie flat mode.
Figure 13:
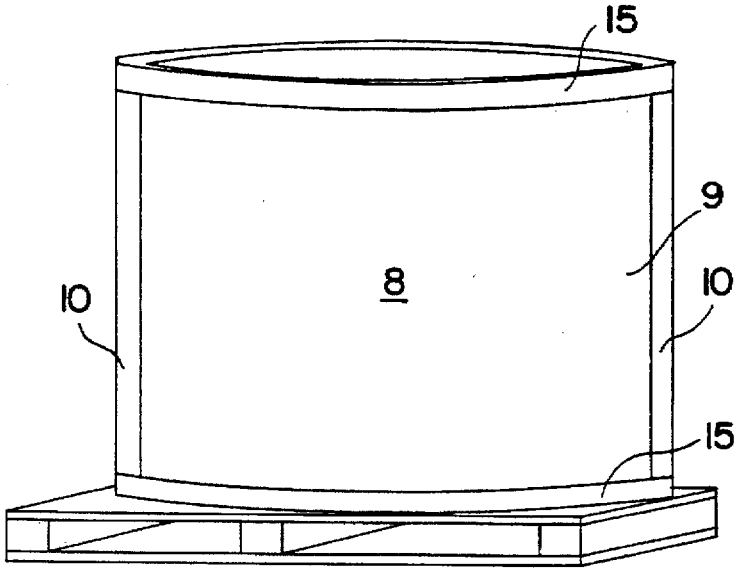
FIG. 13 shows a bin as shown in FIGS. 7 through 12 in an assembled form on a support pallet which may or may not include a slip sheet, FIG. 14 through FIG. 22 shows the components to be formed into a bin as disclosed in any one of FIGS. 7 through 13, and FIGS. 23 through 26 show the nature of the laminations of the various components of a bin as shown in any one of FIGS. 7 through 22.

In the preferred form of the present invention the bin is as depicted in FIG. 13 with member 8 of the outer liner 9 adhesively affixed to the flaps 10 of the component 11. Double score lines of the component 11 provide the panel region 12 best seen in FIGS. 11 and 12 as enabling the lie flat characteristics with facilitates storage with the flute providing medium 18 also in a lie flat intermeshing mode.

Figure 9:
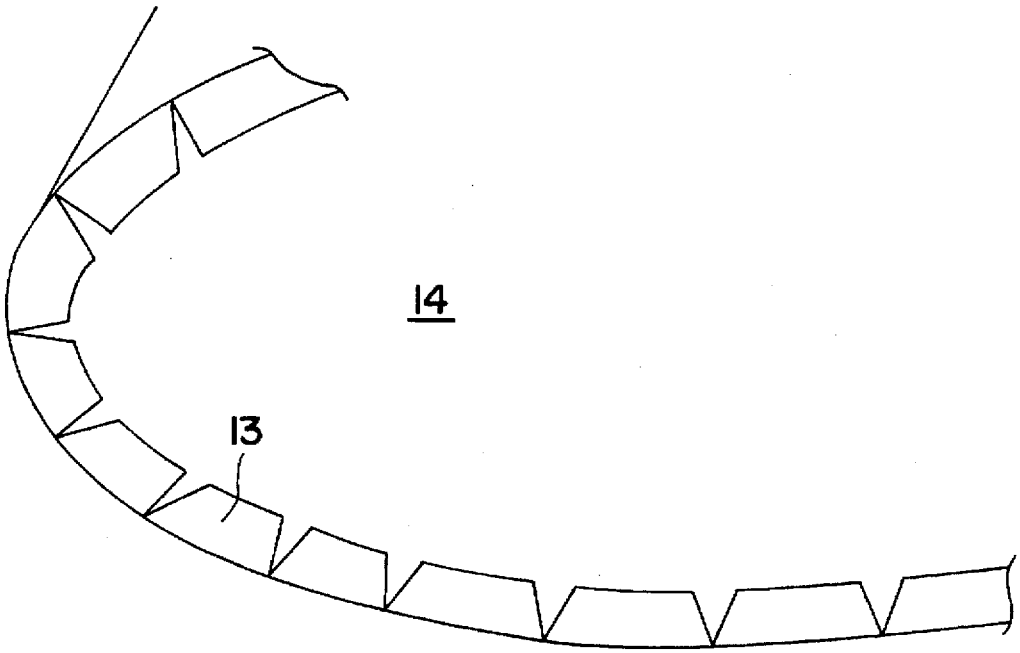
FIG. 9 shows from below a base construction in accordance with the preferred form of the present invention.
Figure 10:
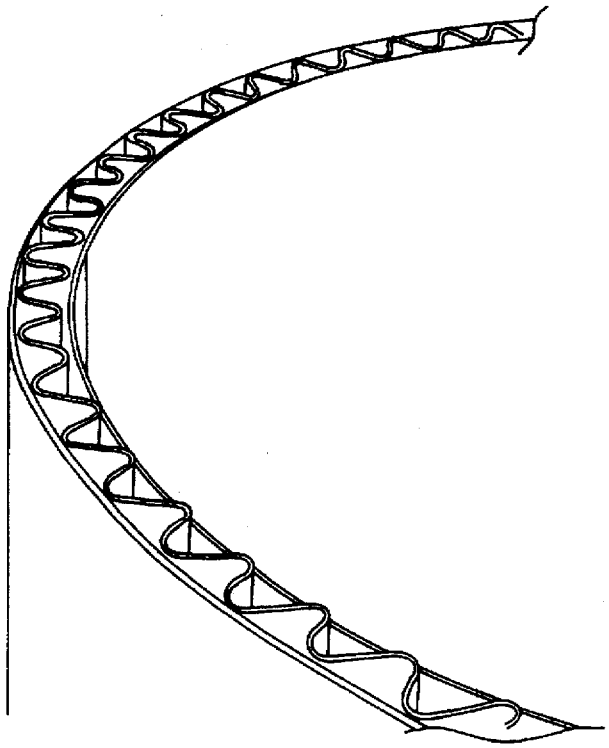
FIG. 10 shows a perspective view of a bin as shown in FIGS. 7 through 9 but also showing fitted over the flute providing medium shown in FIG. 8 a removable lie flat type inner liner.
Figure 11:
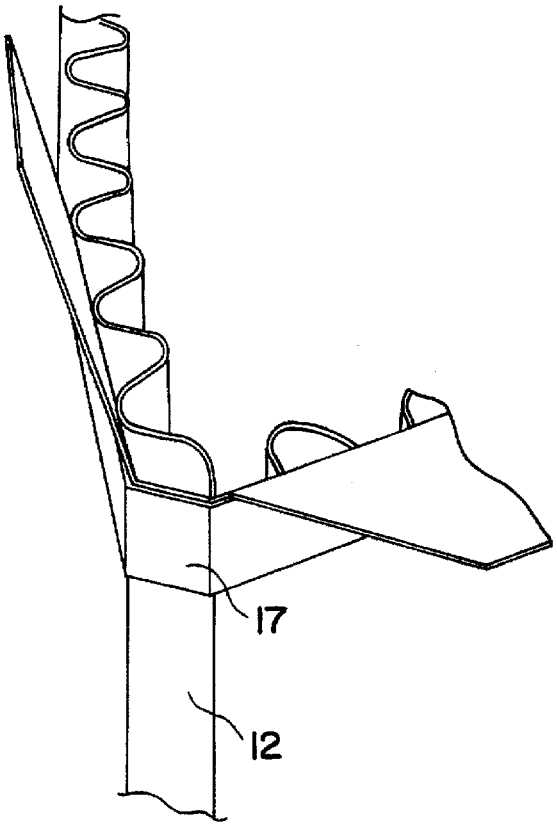
FIG. 11 shows the lie flat character of a bin as shown in FIG. 9 through 10 when the removable inner liner is no longer in place.

Each of components 16 and 17 include flaps 13 which as shown in FIG. 9 underlie and are adhesively affixed to the base 14. Reinforcement bands 15 top and bottom adhered to the outer liner provide the required support of the bin obviating the need for the bands previously described in relation to a first embodiment. Such bands 15 preferably made up each of a pair of members 16 (also with foldlines to provide a panel region 17 which accords with the panel 12 such that the reinforcement bands are also present in the lie flat mode as shown in FIG. 12). In fact the lie flat mode of FIG. 12 shows the base flaps 13 as providing no fetter whatsoever on such lie flat storing and/or carriage of a bin in accordance with the present invention.

The only loose components need be an internal base member 14 the inner sleeve, and a cap member 18 with flaps 19 which facilitate the over gluing thereof down over the top band 15 of an assembled bin as shown in FIG. 13 (the cap not being shown in FIG. 13).

The inner sleeve comprises a component 20 and a component 21, the flaps 22 being adhesively fixed to the ends of the component 21 so as to provide a lie flat sleeve which like the base 14 and the cap 18 can be stored in a lie flat manner with the bin body proper (FIG. 12).

The materials used in the preferred form of the present invention will now be described.

Figure 23:
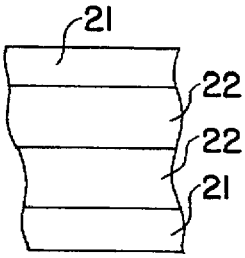

The outer 9, preferably the bands 15 and preferably also the lid 18 is formed of a laminate as disclosed in FIG. 23 where layers 21 are 220 gram/m$^2$ Kraft while the inner two layers of the laminate 22 are each 520 gram/m$^2$ filler board. Preferably the structure is held in a laminated form with an EVA adhesive.

Figure 24:
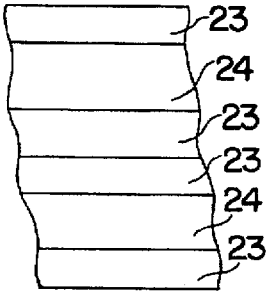

FIG. 24 shows the preferred material of the flutes or flute providing medium 20. In the laminate of FIG. 24, 23 is 160 gram/m$^2$ Kraft liner while layer 24 is 530 gram/m$^2$general purpose box board (ie; a filler board of recycled pulp). Again the whole structure is preferably formed together using an EVA adhesive.

Each of the components shown in FIGS. 14 and 15 have a laminate comprising three layers only so that when laminated together they provide the six layers preferred.

Figure 25:
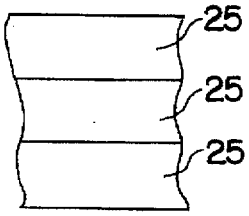

FIG. 25 is the laminate of the inner liner composed of the components 20 and 21. It preferably comprises three layers 25 of 290 gram/m$^2$ Kraft liner preferably again laminated using EVA adhesive.

Figure 20:
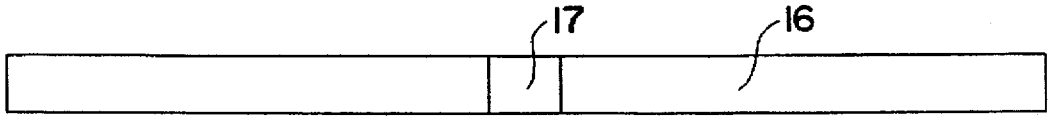

The bands 15 shown in FIG. 13 (formed from components 16 as shown in FIG. 20) are preferably of the laminate described in relation to the outer and the cap ie; as shown in FIG. 23.

Figure 26:
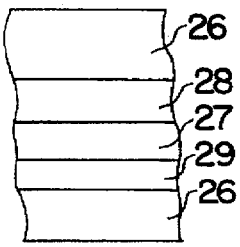

The base is preferably a laminate as shown in FIG. 26 comprising outer layers 26 of 160 gram/m$^2$ Kraft liner. The central layer 27 is 120 gram/m$^2$ Kraft liner while the layer 28 is a "C" flute paper material and the layer 29 of "B" flute paper material. Each of the layers 28 and 29 are of 120 gram/m$^2$ construction.

Preferably all adhesive used [other than in relation to formulating small flute laminates used in the various laminate constructions] is EVA. For the small flute constructions preferably standard starch type adhesives are used. Preferably however for the laminations of the larger than "A" flute providing medium of the present invention, EVA type adhesive is used.

From the foregoing description and the accompanying drawings it can be seen that the preferred form of the present invention can provide a large size bin which has advantages in cost with at least corresponding strength to alternatives for carrying such volumes.

The provision of the separably inner liner which can be inserted as a loose sleeve in order to minimise the bag size required to take up the volume and also to avoid unnecessary stresses on the flute providing medium adds strength to the assembled structure.

I claim:

1. A bin of substantially circular form when viewed in plan, said bin comprising:

an assembly of at least one single-face corrugated structure having flutes running vertically and exposed to an inside of the bin when in an erected form, said at least one single-face corrugated structure including a liner board of at least one ply of kraft paper adhesively laminated to a corrugated laminate of at least two plies, with at least one of said at least two plies including a ply of kraft paper, said corrugated laminate being set in the corrugated form by moisture, heat and pressure, said flutes of the at least one single-face corrugated structure being at least grater than "A" flute size, and a support surface for supporting said at least one single-face corrugated structure.

2. A bin as claimed in claim 1, wherein said at least two plies are each a laminate including at least one ply of kraft paper and the corrugated form and the lamination between said at least two plies being achieved by the at least two plies being laminated together in corrugated form, using an adhesive, by moisture, heat and pressure.

3. A bin as claimed in claim 1, wherein said assembly is of substantially circular shape.

4. A bin as claimed in claim 1, wherein said at least one single face corrugated structure is lapped at at least one point by at least one flute width.

5. A bin as claimed in claim 4, wherein said at least one single-face corrugated structure is lapped at two points by at least one flute width.

6. A bin as claimed in any one of claim 1, wherein said at least one single-face corrugated structure is a laminate of 160 gram/m$^2$ kraft paper liner and a layer of 530 gram/m$^2$ box board.

7. A bin as claimed in claim 6, wherein the corrugated laminate is formed using EVA adhesive.

8. A bin as claimed in any one of claim 1, wherein said at least one single face corrugated structure has a flute pitch of about 54 mm, flute depth of about 27 mm and a take up of about 1.5:1.

9. A bin as claimed in claim 1, wherein said bin is bottomless.

10. A bin as claimed in claim 1, wherein said assembly is encircled by at least one strengthening band.

11. A bin as claimed in claim 10, wherein said assembly is encircled at least at a top and a bottom by said at least one strengthening band.

12. A bin as claimed in claim 10, wherein said encircling band is of a fibreboard construction.

13. A bin as claimed in claim 1, wherein said support surface is supported by a pallet.

14. A bin as claimed in claim 1, wherein said assembly is collapsible to a substantially lie-flat form with the flutes being intermeshed.

15. A bin as claimed in claim 14, wherein said assembly includes hinges along two vertical pairs of fold lines, each fold line providing an edge in said lie-flat form.

16. A bin as claimed in claim 15, wherein said assembly is fabricated from two parts one of which carries both of said pairs of fold lines.

17. A bin as claimed in claim 1, wherein said assembly includes flaps engageable with a disc of a sheet material.

18. A bin as claimed in claim 1, wherein said assembly includes a volume greater than 500 liters, a height grater than 600 mm, and a capability of supporting at least 6 tons in a stacking mode.

19. A bin as claimed in claim 1, further comprising a liner material positioned internally of the assembly to lie against the assembly.

20. A bin as claimed in claim 19, wherein said liner is a sleeve capable of assuming a lie flat mode.

21. A bin as claimed in claim 19, wherein said liner is formed from one of fibreboard and kraft paper.

22. A bin as claimed in claim 19, wherein said liner is formed from laminated kraft paper.

23. A bin as claimed in claim 1, further comprising a plastics bag fillable to conform to the inside of said bin.

24. A bin as claimed in claim 1, further comprising a capping member including a lid region and a skirt or flange region to cap an upper region of the bin.

25. A method of transporting goods comprising:

erecting a bin on a support surface, said bin having an assembly of at least one single-face corrugated structure having flutes running vertically and exposed to an inside of the bin when in an erected form, said at least one single-face corrugated structure including a liner board of at least one ply of kraft paper adhesively laminated to a corrugated laminate of at least two plies, with at least one of said at least two plies including a ply of kraft paper, said corrugated laminate being set in the corrugated form by moisture, heat and pressure, said flutes of the at least one single-face corrugated structure being at least grater than "A" flute size, and a support surface for supporting said at least one single-face corrugated structure, confining the goods to be transported within the bounds of the bin while the bin is supported on said support surface, and retaining the goods within the bin.

26. A lay flat form capable of erection into a bin of a substantially circular form when viewed in plan, said lay flat form comprising:

an assembly of at least one single-face corrugated structure including a liner board of at least one ply of kraft paper adhesively laminated to a corrugated laminate of at least two plies, with at least one of said at least two plies including a ply of kraft paper, said corrugated laminate being set in the corrugated form by moisture, heat and pressure, said flutes of the at lest one single-face corrugated structure being at least greater than "A" flute size, wherein said corrugated structure has a flute pitch of about 54 mm, flute depth about 27 mm and a take up of about 1.5:1.

27. A lay flat form as claimed in claim 26, wherein said at least one single-face corrugated structure is a laminate of 160 gram/m$^2$ kraft paper liner and a layer of 530 gram/m$^2$ box board.

28. A lay flat form as claimed in claim 27, wherein said laminate is formed using EVA adhesive.

29. A tubular structure bin comprising:

an assembly of at least one single-face corrugated having flutes running vertically and exposed to an inside of the bin when in an erected form, said at least one single-face corrugated structure including a liner board of at least a ply of kraft paper adhesively laminated to a corrugated laminate of at least two plies, with at least one of said at least two plies including a ply of kraft paper, said corrugated laminate being set in the corrugated form by moisture, heat and pressure, said flutes of the at least one single-face corrugated structure being at least greater than "A" flute size, wherein said corrugated structure has a flute pitch of about 54 mm, flute depth of about 27 mm and a take up of about 1.5:1.

30. A tubular structure as claimed in claim 29, wherein said at least two plies are each a laminate including at least one ply of kraft paper and the corrugated form and the lamination between said at least two plies being achieved by the at least two plies being laminated together in corrugated form, using an adhesive, by moisture, heat and pressure.

31. A tubular structure as claimed in claim 29, wherein said assembly is of substantially circular shape.

32. A tubular structure as claimed in claim 29, wherein said at least one single-face corrugated structure is lapped at at least one point by at least one flute width.

33. A tubular structure as claimed in claim 32, wherein said at least one single-face corrugated structure is lapped at two points by at least one flute width.

34. A tubular structure as claimed in claim 29, wherein said at least one single-face corrugated structure is a laminate of 160 gram/m$^2$ kraft paper liner and a layer of 530 gram/m$^2$ box board.

35. A tubular structure as claimed in claim 34, wherein the corrugated laminate is formed using EVA adhesive.

36. A tubular structure as claimed in claim 29, wherein said assembly is encircled by at least one strengthening band.

37. A tubular structure as claimed in claim 36, wherein said assembly is encircled at least at a top and a bottom by said at least one strengthening band.

38. A tubular structure as claimed in claim 36, wherein said at least one strengthening band is of a fibreboard construction.

* * * * *

UNITED STATES PATENT AND TRADEMARK OFFICE

CERTIFICATE OF CORRECTION

PATENT NO. : 5,702,052

DATED : December 30, 1997

INVENTOR(S) : Craig R. BONNER

It is certified that error appears in the above-identified patent and that said Letters Patent is hereby corrected as shown below:

Column 6, line 23, change "grater" to --greater--; and

Column 7, line 50, change "lest" to --least--.

Signed and Sealed this

FourthDay of August, 1998

Bruce Lehman

*Attest:*

BRUCE LEHMAN

*Attesting Officer*

*Commissioner of Patents and Trademarks*